US006450439B1

(12) United States Patent
van Rees

(10) Patent No.: US 6,450,439 B1
(45) Date of Patent: Sep. 17, 2002

(54) TOILET PAPER ROLL DISPENSER

(76) Inventor: Dirk van Rees, 3814 Vermont Rd., Atlanta, GA (US) 30319

( * ) Notice: Subject to any disclaimer, the term of this patent is extended or adjusted under 35 U.S.C. 154(b) by 0 days.

(21) Appl. No.: 09/679,609

(22) Filed: Oct. 5, 2000

(51) Int. Cl.[7] ..... B65H 16/04

(52) U.S. Cl. ..... 242/597.7; 242/596.4; 242/598.5; 242/599.2

(58) Field of Search ..... 242/597, 597.6, 242/597.7, 597.8, 597.5, 596, 596.4, 598, 598.3, 598.5, 599, 599.2; D6/521

(56) References Cited

U.S. PATENT DOCUMENTS 2,562,923 A * 8/1951 Kolivoski
2,928,618 A * 3/1960 Locke
3,370,805 A * 2/1968 Barbee
3,844,500 A 10/1974 Krause
3,941,325 A 3/1976 Krause
4,063,694 A * 12/1977 Lemin
4,273,299 A * 6/1981 Ness
D259,906 S * 7/1981 Fleischmann et al.
4,416,425 A 11/1983 Kish
5,653,403 A 8/1997 Richey ..... 242/597.5
D389,685 S * 1/1998 Marroquin
5,799,895 A * 9/1998 Michaud et al.
6,116,534 A * 9/2000 Morand
6,231,000 B1 * 5/2001 Wood

* cited by examiner

*Primary Examiner*—William A. Rivera
(74) *Attorney, Agent, or Firm*—Jacobson Holman, PLLC

(57) ABSTRACT

A toilet paper dispenser for use in connection with conventional mounting brackets. The dispenser includes a U-shaped bracket having mounting points extending horizontally outwardly from each end which are configured to engage conventional toilet paper dispenser mounting brackets. Extending upwardly from the base portion of the U-shaped bracket is a cylindrical spindle configured to engage a hollow cylindrical toilet paper roll. During use, the mounting brackets are engaged in conventional mounting brackets so that the center of gravity of the dispenser lies below the horizontal plane of the mounting brackets. The hollow tube of a toilet paper roll is inserted over the spindle so that the toilet paper roll is oriented vertically with respect to the mounting brackets.

12 Claims, 11 Drawing Sheets

TOILET PAPER ROLL DISPENSER

BACKGROUND OF THE INVENTION

1. Field of the Invention

The present invention relates to toilet paper roller dispensers. More specifically, the invention relates to dispensers for use with the mounting brackets of conventional toilet paper roll dispensers. The inventive dispenser eliminates the need for a spring-loaded spindle commonly found in conventional toilet paper roll dispensers.

2. Related Art

U.S. Pat. No. 5,653,403 to Ritchey teaches a toilet paper holder and dispenser adapted for use with a conventional toilet paper holder. Ritchey's devices attaches to the spring-loaded spindle of a conventional roll dispensing apparatus. It includes a peg that extends outwardly from the spindle and is configured to receive a toilet paper roll.

U.S. Pat. No. 4,416,425 to Kish teaches a toilet paper holder and dispenser including a pair of support arms that can rotate about their axes and a spindle attached at one end to one of the support arms. Paper rolls are loaded and removed by rotating the arm to which the spindle is attached so that the free end of the spindle is rotated to point vertically upwardly from that arm. Kish's device cannot be used with a conventional dispenser; rather, it requires rotatable support arms.

U.S. Pat. Nos. 3,942,325 and 3,844,500 to Krause teach a horizontal shelf adapted to rest on a horizontal bar, such as a bathroom or kitchen towel bar. A post extends vertically upwardly from the horizontal shelf for receiving a roll of paper, such as a paper towel roll.

None of these toilet paper roll dispensers can be used in connection with only the mounting brackets of a conventional toilet paper roll dispenser. In particular, Ritchey's devices requires use of the spring-loaded spindle of a conventional dispenser and operates to balance the weight of a paper roll above the spindle. Therefore, it is desirable to provide a toilet paper roll dispenser adapted for use with a conventional dispenser which eliminates the need for the spring-loaded spindle of the conventional dispenser and positions a paper roll so that its center of gravity is located below the mounting brackets. It is also desirable to provide a toilet paper roll dispenser that orients a toilet paper roll vertically rather than horizontally so that it is capable of easily accommodating oversize or "double" rolls of toilet paper.

SUMMARY OF THE INVENTION

The present invention provides a toilet paper roll holder and dispenser for use with the mounting brackets of a conventional dispenser. The inventive dispenser eliminates the need for the spring-loaded spindle of conventional dispensers. It positions the paper roll so that its axis of rotation is oriented vertically with respect to the base portion of the inventive mounting bracket. This allows the dispenser to easily accommodate regular or oversize rolls of toilet paper. The invention further provides a wall-mounted toilet paper dispenser which orients a toilet paper roll vertically to easily accommodate regular or oversize rolls of toilet paper.

According to the first embodiment of the invention, the inventive device is a single piece U-shaped bracket design adapted for mounting between the mounting brackets of a conventional dispenser. The device includes an upwardly protruding shaft or spindle configured to receive a roll of toilet paper. The shaft has a conical base portion which provides friction between the bottom edge of a toilet paper roll and the shaft during use. The friction prevents the paper roll from rotating too quickly or too easily around the shaft when the paper is pulled relatively vigorously, thereby preventing too much paper from being dispensed.

The second embodiment is a variation of the single piece design of the first embodiment. The upwardly protruding shaft or spindle includes projections that extend vertically outwardly from the outer surface of the shaft to center and hold a roll of toilet paper on the spindle.

The third embodiment is a further variation of the single piece design of the first embodiment in which projections on the outer surface of the upwardly protruding shaft or spindle are outwardly extending flexible hooked arms.

The fourth embodiment is a two piece design in which an outer shaft or spindle is designed to slide over the upwardly protruding inner shaft or spindle and engages the top end of the upwardly protruding inner shaft in a snap fit. The bottom portion of the outer shaft has a lip that presses against first and second flexible platforms provided on the upper surface of the bracket around the inner shaft to provide a friction and outer shafts. This prevents the outer shaft from rotating too freely around the inner shaft. The friction between the inner and outer shafts allow even dispensing of paper during use. Flexible projections are provided on the outer surface of the outer shaft to center and hold a toilet paper roll in place over the outer shaft.

The fifth embodiment is a three piece design including the U-shaped bracket having an upwardly protruding inner shaft or spindle and an outer shaft or spindle having flexible projections on its outer surface to center and hold a toilet paper roll on the outer shaft. A cap configured to engage the inner and outer shafts in a snap fit is also provided to orient and secure the toilet paper roll over the inner and outer shafts. Flexible tabs are connected to the inner shaft to provide a friction fit between the inner and outer shafts.

The sixth embodiment is a two piece design in which the projections on the outer shaft or spindle for centering and holding a paper roll are connected at one end to the bottom end of the outer shaft during the manufacturing process. During assembly, each projection is bent upward and its top end is connected to notches in the top portion of the outer shaft in a snap fit. The inner shaft or spindle has flexible tabs attached thereto to provide a friction fit between the inner and outer shafts.

According to the seventh embodiment of the invention, the inventive dispenser includes a single mounting bracket that can be attached to a wall, counter, or other vertical surface, a platter for supporting a toilet paper roll, an upwardly protruding shaft and a cap for securing a toilet paper roll in place over the shaft. The dispenser orients the axis of rotation of the paper roll vertically so that it can easily accommodate regular or oversize toilet paper rolls. This embodiment of the invention eliminates the need for use of mounting brackets of a conventional dispenser.

Other objects, features and advantage of the present invention will be apparent to those skilled in the art upon a reading of this specification including the accompanying drawings.

BRIEF DESCRIPTION OF THE DRAWINGS

The present invention is better understood by reading the following Detailed Description of the Preferred Embodiments with reference to the accompanying drawing figures, in which like reference numerals refer to like elements throughout, and in which.

DETAILED DESCRIPTION OF THE PREFERRED EMBODIMENTS

Figure 1:
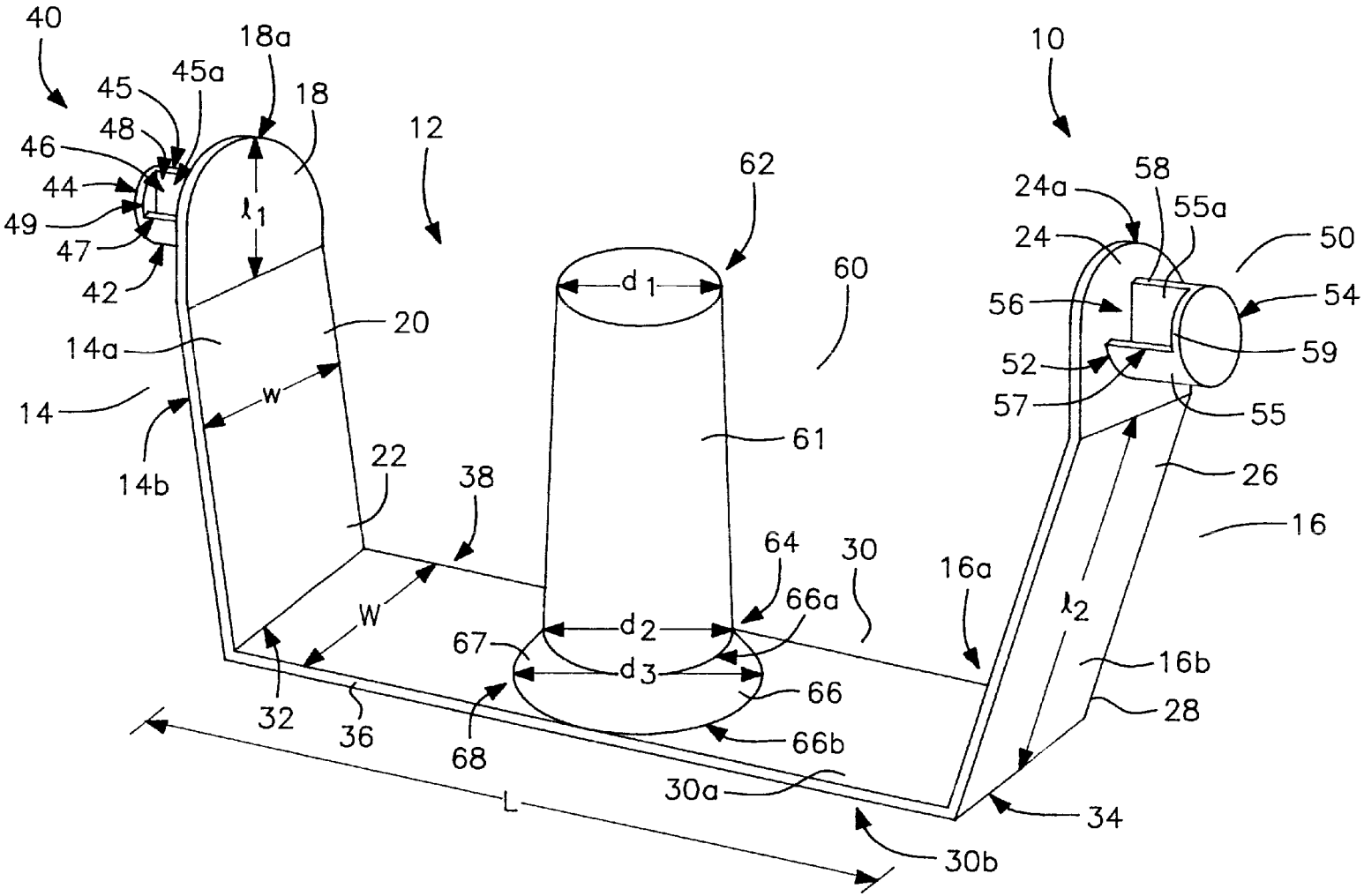
FIG. 1 is a perspective view of the first embodiment of the invention.

In describing the preferred embodiments of the present invention illustrated in the drawings, specific terminology is employed for the sake of clarity. However, the invention is not intended to be limited to the specific terminology so selected, and it is to be understood that each specific element includes all technical equivalents that operate in a similar manner to accomplish a similar purpose.

The first through sixth embodiments of the present invention are adapted for use with a pair of conventional mounting brackets 5 typically used in connection with a conventional toilet paper roll holder and dispenser. As illustrated in FIG. 1A, each conventional mounting bracket 5 typically includes an indentation 5*a* on its inner surface 6 that is configured to engage the ends of a conventional spring-loaded spindle 7. A toilet paper roll is inserted on the conventional spring-loaded spindle and the ends 7A, 7B of the spindle are inserted into the indentation 5*a* of each mounting bracket 5. The first through sixth embodiments of the inventive device eliminate the need for the conventional spring-loaded spindle.

First Embodiment of the Invention

Figure 1A:
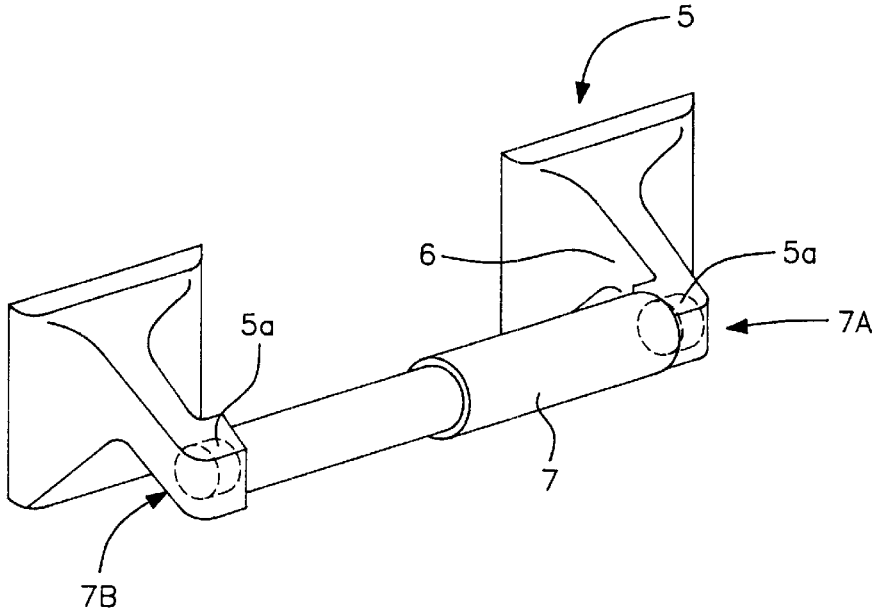
FIG. 1A (PRIOR ART)
FIG. 1A is a perspective view of a conventional mounting bracket for a toilet paper roll holder.
Figure 1C:
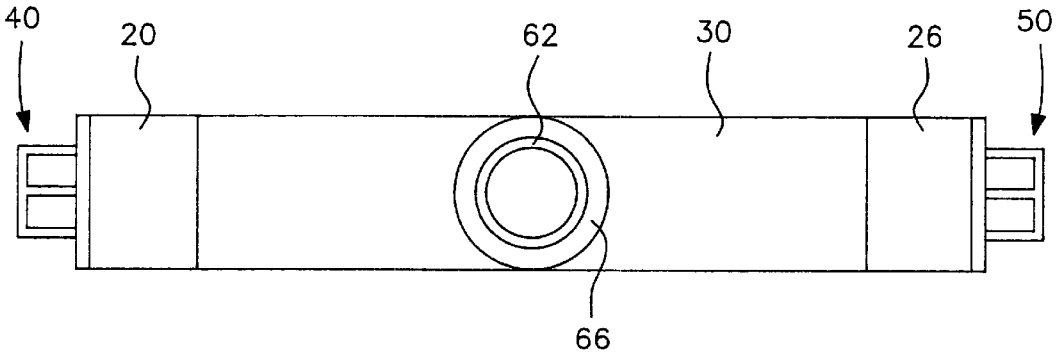
FIG. 1C is a top view of the first embodiment of the invention.
Figure 1B:
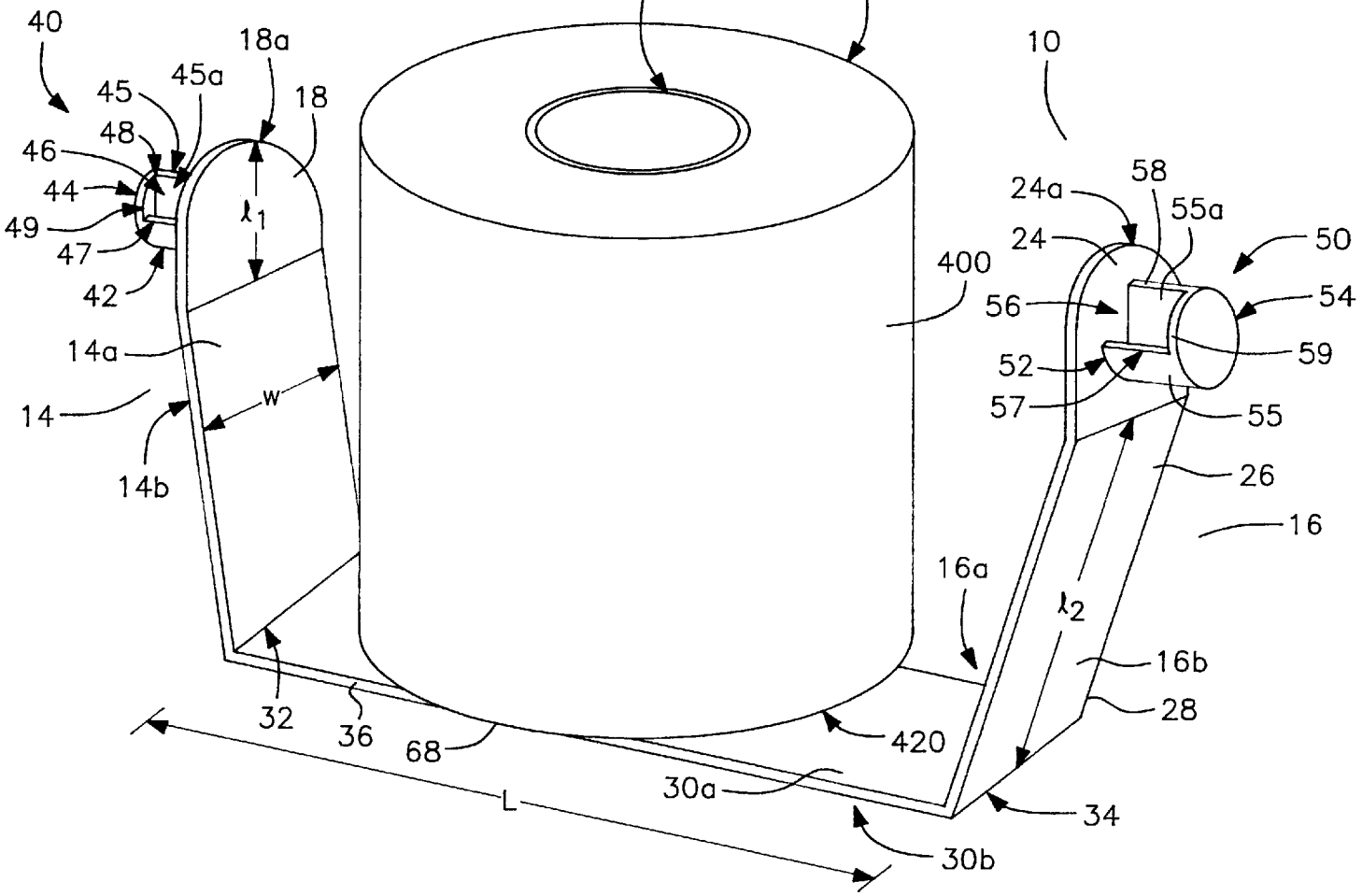
FIG. 1B is a perspective view of the first embodiment of the invention used in connection with a toilet paper roll.
Figure 1D:
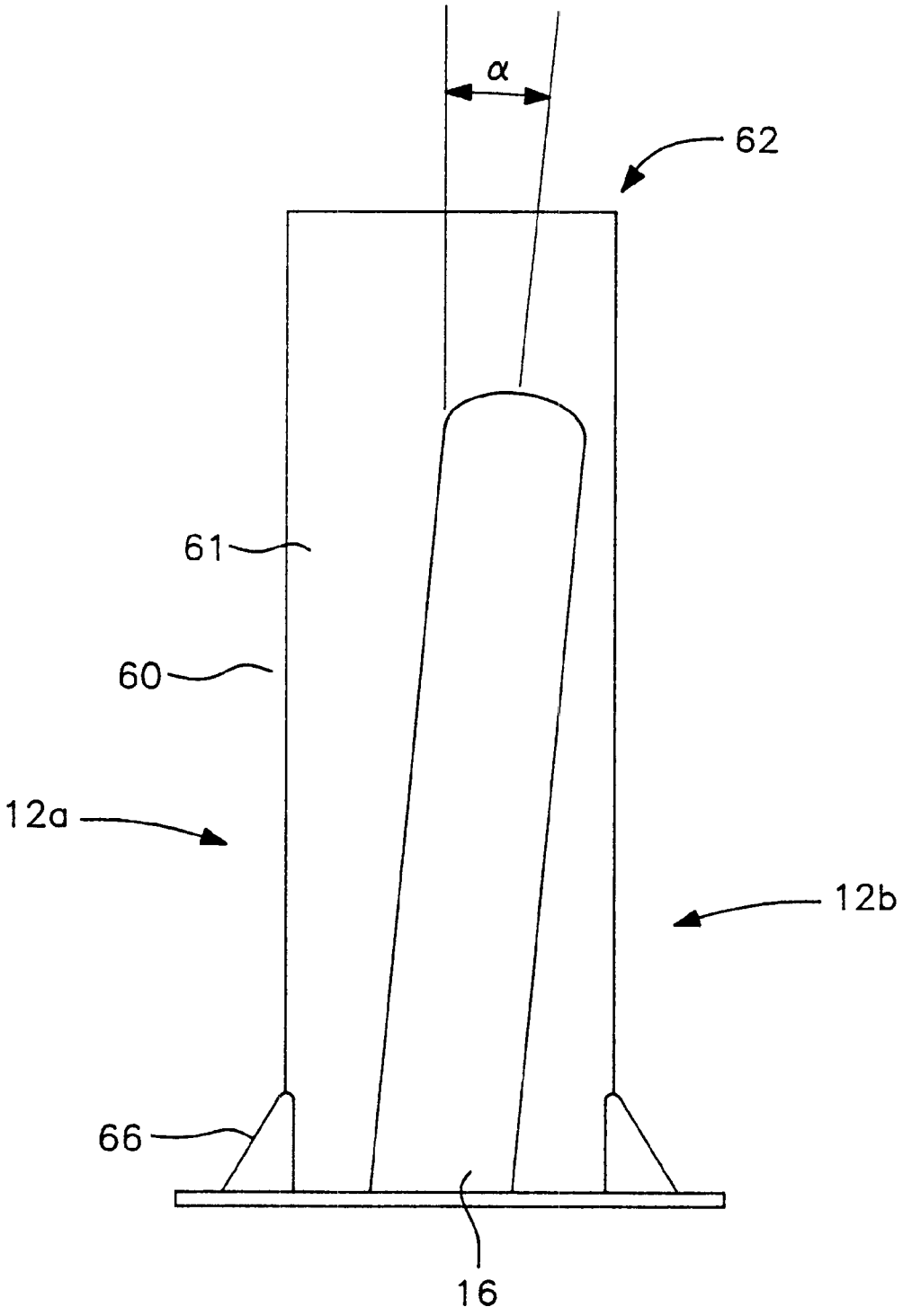
FIG. 1D is a side view of the first embodiment of the invention.

As illustrated in FIGS. 1 through 1D, the first embodiment of the invention is a single piece design. The inventive dispenser 10 of the first embodiment is formed of a U-shaped bracket 12 having first and second arms 14, 16 and a base portion 30. First and second arms 14, 16 have inner surfaces 14*a,* 16*a* and outer surfaces 14*b,* 16*b;* top ends 18, 24; body portions 20, 26; and bottom ends 22, 28. Top ends 18, 24 of first and second arms 14, 16 are oriented at an angle of about 170 to 180 degrees relative to body portions 20, 26 of first and second arms 14, 16. Top end surfaces 18*a,* 24*a* of first and second arms 14, 16 are preferably rounded. The length $\mathbf{1}_1$ of top portions 18, 24 of first and second arms 14, 16 is preferably about ¾", the length $\mathbf{1}_2$ of body portions 20, 26 of first and second arms 14, 16 is preferably 4", and the width W of body portions 20, 26 of first and second arms 14, 16 is preferably 1 ½.

Base portion 30 of U-shaped bracket 12 is preferably rectangularly shaped, having upper surface 30*a,* lower surface 30*b,* first and second ends 32, 34, first and second sides, 36, 38, a length L of about 5 ⅝" and a width W of about 1 ½" to 2". Bottom ends 22, 28 of first and second arms 14, 16 are attached to first and second ends 32, 34 of base portions 30 and extend upwardly and outwardly therefrom at an angle of about 100 degrees.

First and second mounting points 40, 50 extend outwardly from outer surfaces 14*b,* 16*b* of first and second arms 14, 16 at their top ends 18, 24. First and second mounting points 40, 50 are configured to engage indentations 5*a* in a pair of conventional mounting brackets 5 of a conventional toilet paper roll dispenser to hold the inventive dispenser 10 in place between mounting brackets 5.

Figure 7A:
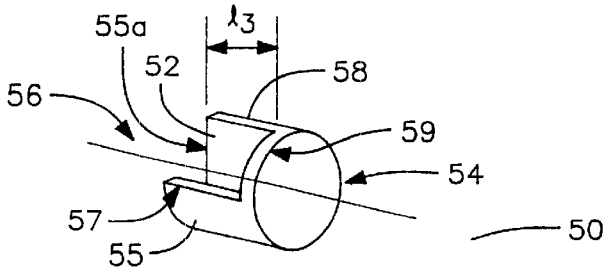
FIGS. 7A, 7B, 7C and 7D are perspective views of alternative embodiments of the mounting points of the inventive toilet paper holder and dispenser.

Preferably, as shown in FIGS. 1 and 7A, first and second mounting points 40, 50 are formed of hollow cylinders protruding outwardly from outer surfaces 14*b,* 16*b* of first and second arms 14, 16 of U-shaped bracket 21 at their top ends 18, 24. Each mounting point 40, 50 has an inner end 42, 52 adjacent to and attached to outer surface 14*b,* 16*b* of top ends, 18 24 of first and second arms 14, 16; an outer end 44, 54; a cylindrically-shaped sidewall 45, 55; an inner surface 45*a,* 55*a;* and a notch 46, 56 formed therein. Each notch 46, 56 is defined by first horizontal sides 47, 57; second horizontal sides 48, 58 and third vertical sides 49, 59. First horizontal sides 47, 57; are parallel to second horizontal sides 48, 58 and are spaced apart from first and second horizontal sides 48, 58 by third vertical sides 49, 59. Notches 46, 56 may be located at any position along the circumference of sidewall 45, 55. Outer ends 44, 54 of first and second mounting points 40, 50 preferably have a diameter of about ⅜", the length $\mathbf{1}_3$ between outer ends 44, 54 and inner ends 42, 52 is preferably about ¼", the length of first and second horizontal sides 47, 57, 48, 58 is preferably 3⁄16" and length of the third vertical sides 49, 59 is preferably about 5⁄16". The thickness of sidewalls 45, 55 will normally be about 1⁄16" depending on the type of thermoplastic used.

A cylindrically shaped spindle or shaft 60 extends vertically upwardly about 4 ½" from upper surface 30*a* of base portion 30. Shaft 60 includes a top end 62, a bottom end 64, an outer surface 61, and a cone-shaped cylindrical base portion 66. Top end 62 of shaft 60 preferably has a diameter $d_1$ of about 1 7⁄16". Cone-shaped base portion 66 includes a top end 66*a* adjacent bottom end 64 of shaft 60, a bottom end 66*b* and a bottom surface 68 adjacent upper surface 30*a* of base portion 30 of shaft 60. Outer surface 67 of circular base portion 66 of shaft 60 flares outwardly from top end 66*a* to bottom end 66*b* of base portion 66 at an angle of about 45 degrees from vertical. The diameter $d_2$ of top portion 66*a* is preferably about 1 9⁄16" and the diameter $d_3$ of bottom portion 66*b* is preferably 2". Bottom surface 68 of base portion 66 of shaft 60 is adjacent to and attached to upper surface 30*a* of base portion 30 of U-shaped bracket 12 at the center of base portion 30. Preferably, shaft 60 and U-shaped bracket 12 are injection molded as one piece and shaft 6 is hollow.

As shown in FIG. 1B, a hollow cylindrical roll of toilet paper 400 is inserted over shaft 60 so that the axis of rotation of paper roll 400 is vertically oriented and paper roll 400 extends vertically upwardly from upper surface 30*a* of base portion 30 of device 10. Thus, paper roll 400 is vertically oriented with respect to a pair of conventional mounting brackets 5 (not shown) so that the center of gravity of paper roll 400 is balanced below first and second mounting points 40, 50 and, during use, below mounting brackets 5. The bottom edge (not shown) of the hollow cylinder 410 around which paper is wrapped to form paper roll 400 is preferably located adjacent to top end 66*a* of base portion 66. The flared outer surface 67 of base portion 66 prevents the bottom edge 420 of the paper roll 400 from resting on upper surface 30*a* of base portion 30 of U-shaped bracket 12. Cone-shaped base portion 66 provides friction between cylinder 410 of paper roll 400 and shaft 60 to allow for even dispensing during use. Specifically, the friction created between cone-shaped base portion 66 and cylinder 410 of paper roll 400 prevents the roll from rotating around shaft 60 too quickly and dispensing too much paper when the roll is pulled relatively vigorously.

Preferably, as illustrated in FIG. 1D, when the user mounts dispenser 10 between conventional mounting brackets 5, front end 10*a* of dispenser 10 faces outwardly and rear end 10*b* faces the wall, and dispenser 10 is mounted at an angle $\alpha$ relative to the wall so that the top end 405 of paper roll 400 mounted on shaft 60 leans slightly outwardly from the wall and the base of the paper roll rests against the wall. Preferably, the angle $\alpha$ is about 5–10 degrees. This allows device 10 to easily accommodate oversize paper rolls and allows smooth distribution when paper is dispensed from oversized rolls. As the paper is pulled, the base of the paper roll pulls away from the wall.

Second Embodiment of the Invention

Figure 2:
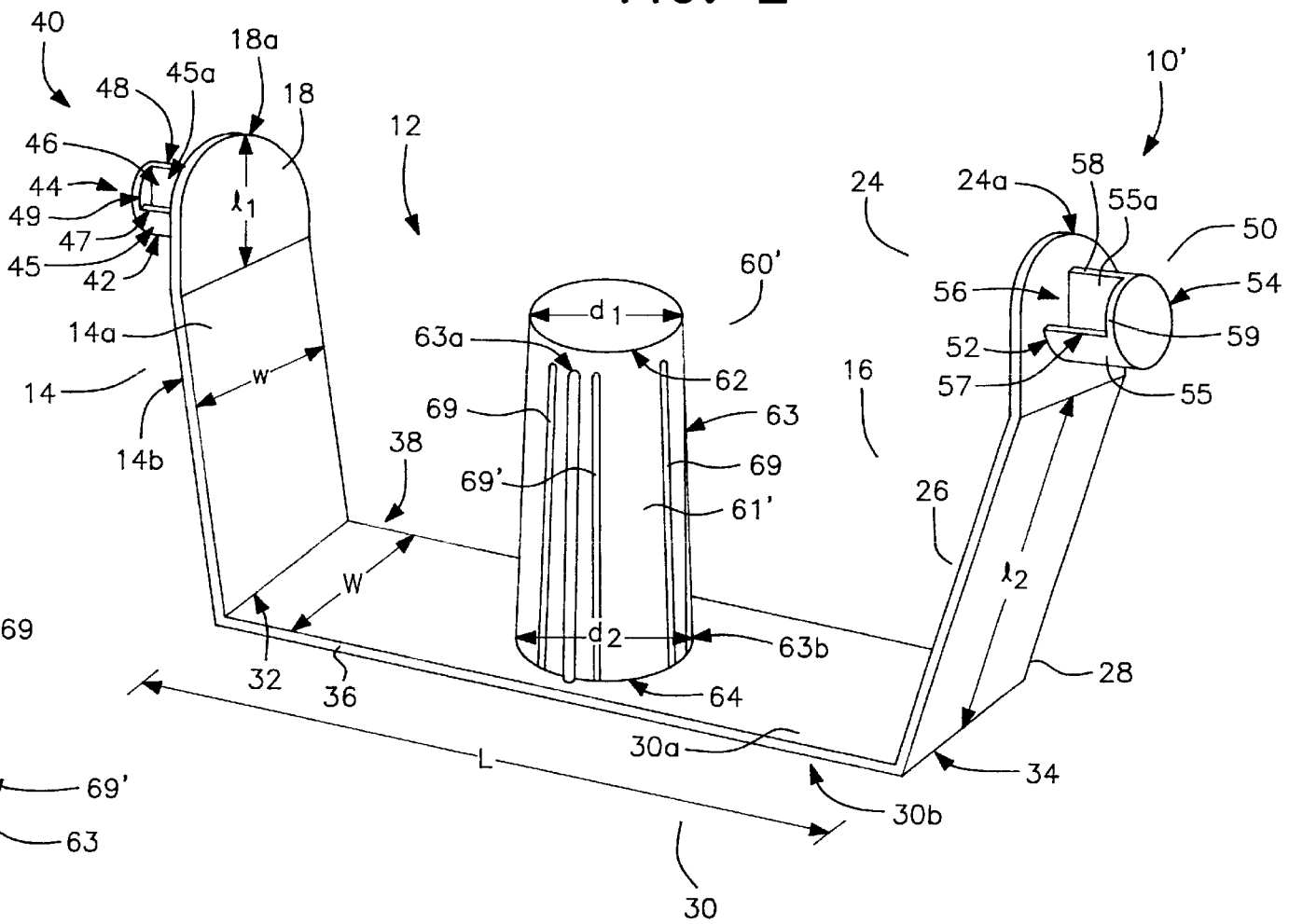
FIG. 2 is a perspective view of the second embodiment of the invention.
Figure 2A:
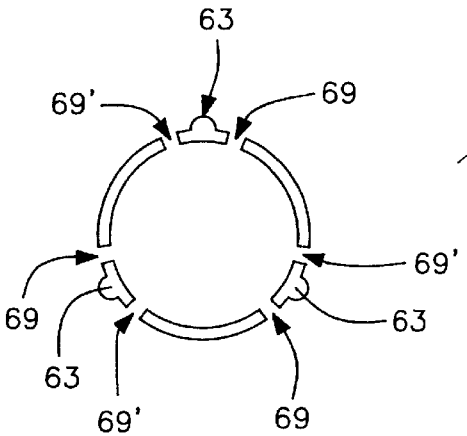
FIG. 2A is a top view of the shaft of the second embodiment of the invention.

Referring to FIGS. 2 and 2A, like structures are indicated by the same reference numerals used in FIGS. 1 through 1D unless otherwise indicated. According to the second embodiment of the invention as illustrated in FIGS. 2 and 2A, outer surface 61' of hollow cylindrical shaft 60' of inventive dispenser 10' is provided with a plurality of rib-shaped projections 63 each having a top end 63*a* and a bottom end 63*b*. Each projection 63 has a first and second slot 69, 69' located on either side of projection 63 and parallel thereto.

Projections 63 extend vertically outwardly from outer surface 61' of shaft 60' as follows. Top end 63*a* of each projection 63 is attached to outer surface 61' of shaft 60'. Bottom end 63*b* of each projection 63 is unattached and is spaced apart from outer surface 61' and bottom end 64 of shaft 60'. When a toilet paper roll is inserted over shaft 60', the inner surface of the roll contacts projections 63 and presses against the free bottom end 63*b* of each projection 63. Thus, projections 63 center the paper roll over shaft 60' and hold it in place.

Preferably, shaft 60' is about 4 ½" long, and about 3 projections 63 are provided on outer surface 61' of shaft 60'. The length of each projection 63 is preferably about 4", the width of each projection 63 is about ¼", and the distance between bottom end 63*b* of each projection 63 and bottom end 64 of shaft 61' is about 1/16". The length of each slot 69, 69' is about 4 ⅛" and the width of each slot is about 1/16". Each projection 63 is preferably located on outer surface 61' of shaft 60' so that its top end 63*a* is located about ½" from top 62 of shaft 60'and its bottom and 63*b* is located adjacent to and spaced apart from bottom end 64 of shaft 60'. All other dimensions of dispenser 10' correspond to those for device 10 of the first embodiment.

Third Embodiment of the Invention

Figure 3:
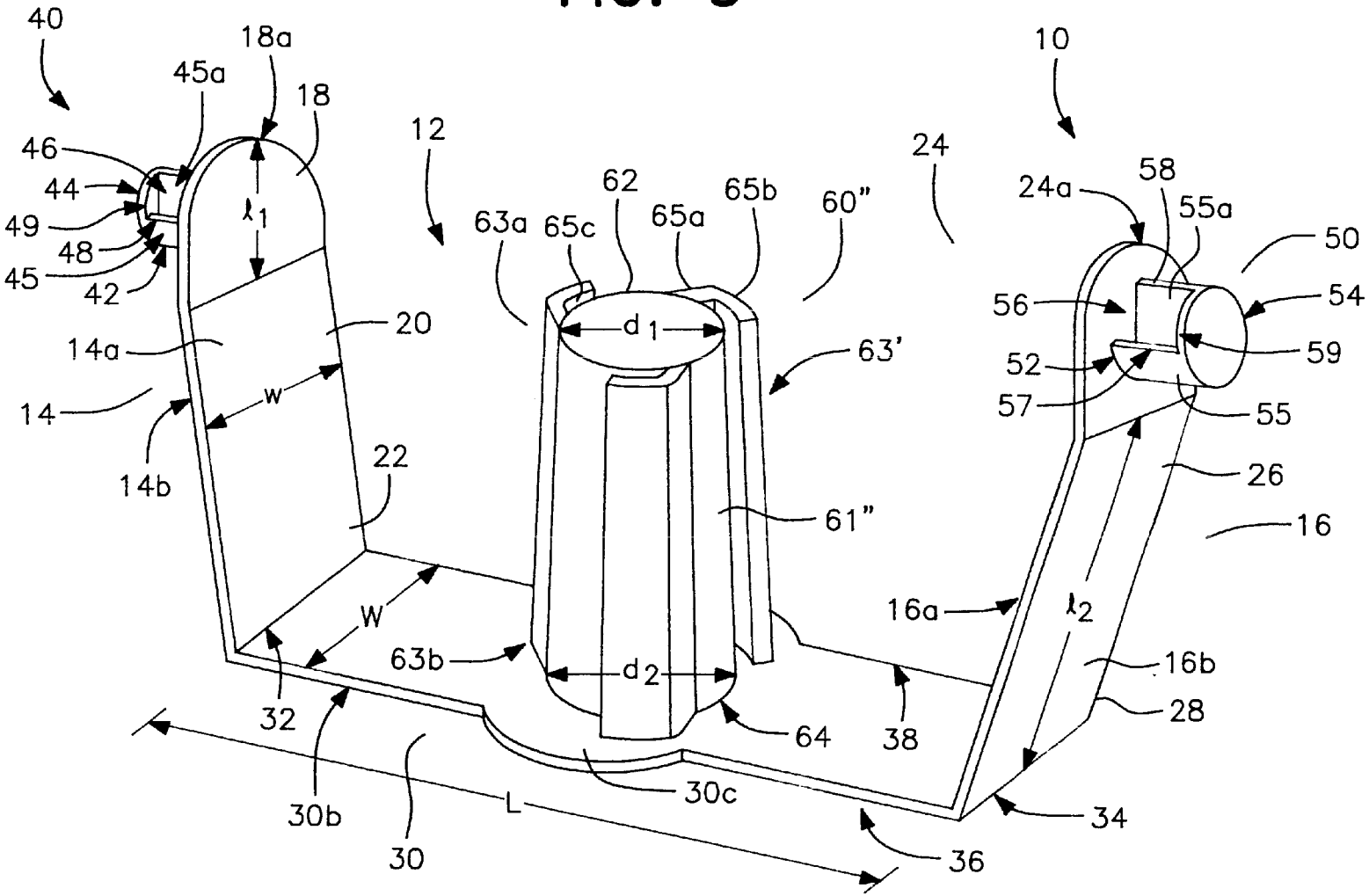
FIG. 3 is a perspective view of the third embodiment of the invention.

Referring to FIG. 3, like structures are indicated by the same reference numerals used in FIGS. 1 through 1D, 2 and 2A unless otherwise indicated. The third embodiment of the invention is illustrated in FIG. 3. Projections 63' provided on outer surface 61" of shaft 60" of dispenser 10" are flexible, longitudinally extending, angled ribs that protrude vertically outwardly from outer surface 61" of shaft 60". Each projection 63' includes a top end 63*a* located adjacent top 62 of shaft 60", a bottom end 63*b* ' located adjacent to bottom 64 of shaft 60" and connected to upper surface 30*a* of base portion 30, and further includes a first portion 65*a,* a second portion 65*b* and an inner surface 65*c*.

First portion 65*a* extends vertically outwardly from outer surface 61" at an angle of about 45 degrees and second portion 65*b* extends vertically outwardly from first portion 65*a* at an angle of about 135 degrees, thereby forming an angled rib. The length of each projection 63' is preferably about 4 7/16", and the width of first portion 65*a* and second portion 65*b* at the top end 62 of shaft 60" is preferably ¼" and flares outwardly to a width of about ⅜" at bottom end 64 of shaft 60". Thus, the width of each projection 63 flares slightly outwardly from top end 62 to bottom end 64 of shaft 60". Thus, the width of each projection 63 flares slightly outwardly from top end 62 to bottom end 64 of shaft 60". The depth of each projection 63' is preferably about ¼". Inner surface 65*c* of projections 63' is preferably spaced apart from outer surface 61" of shaft 60" by a distance of about 3/16".

Base 30 may include semicircular side portions 30*c* extending outwardly from first and second sides 36, 38 of base 30 and located adjacent shaft 60". Side portions 30*c* provide additional strength to base 30 of U-shaped bracket 12.

As discussed above in relation to the second embodiment, projections 63' center the paper roll over shaft 60" and hold the paper roll in place over shaft 60". As noted above, projections 63' are flexible. This allows shaft 60" to easily accommodate cylinders of paper rolls having varying diameters.

Fourth Embodiment of the Invention

Figure 4:
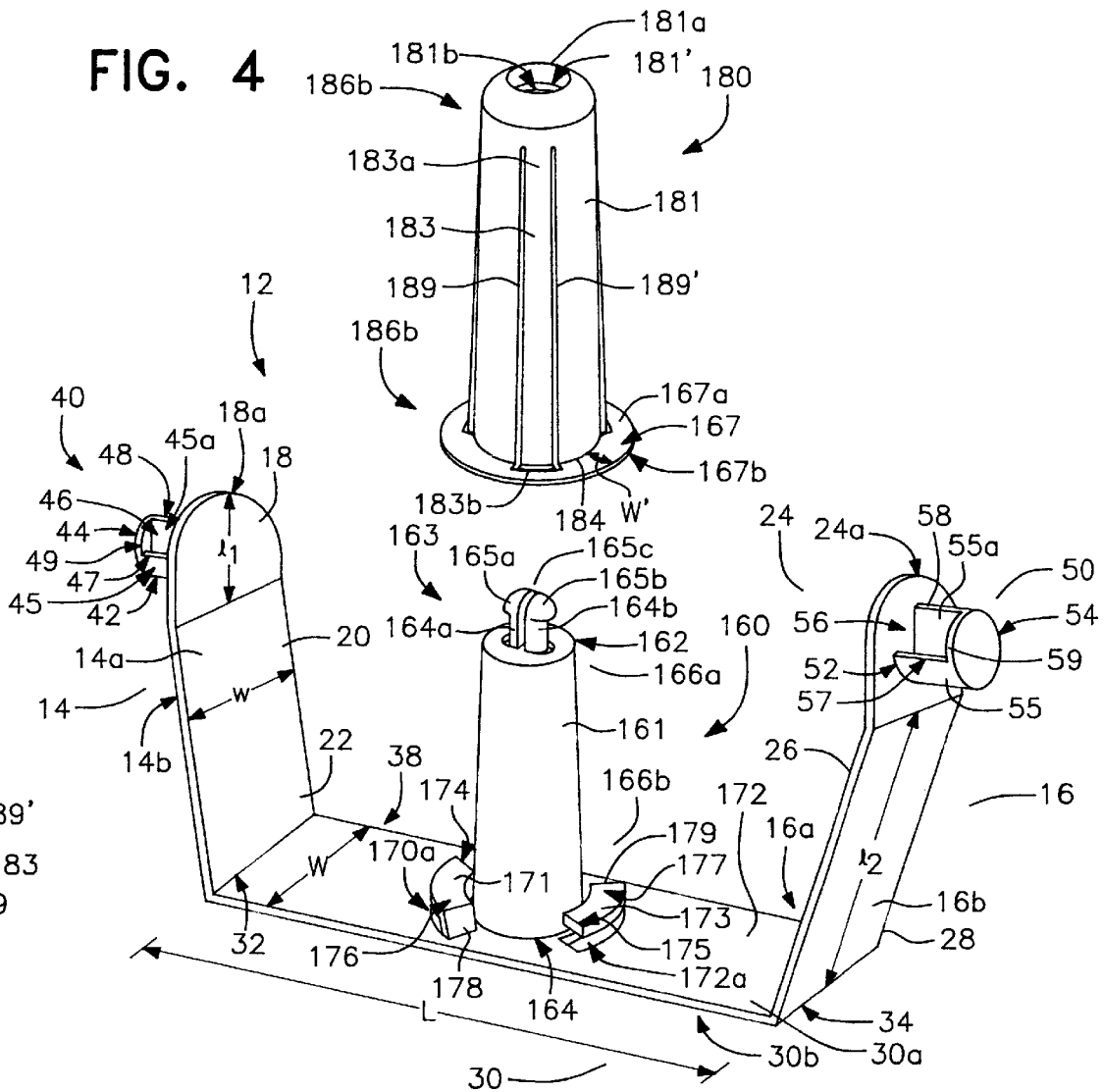
FIG. 4 is an exploded view of the fourth embodiment of the invention.
Figure 4A:
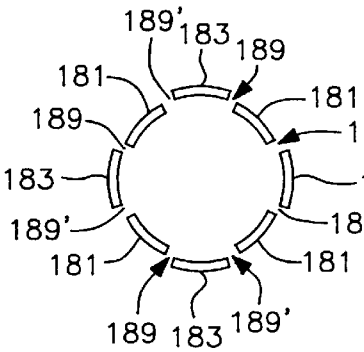
FIG. 4A is a top view of the outer shaft of the fourth embodiment of the invention.

Referring to FIGS. 4 and 4A, like structures are indicated by the same reference numerals used in FIGS. 1–1D, 2, 2A, and 3 unless otherwise indicated. As illustrated in FIGS. 4 and 4A, the fourth embodiment of the invention is a two piece design. Dispenser 100 includes an inner shaft 160 and an outer shaft 180. Inner shaft 160 and U-shaped bracket 12 are preferably injection molded as one piece and inner shaft 160 is hollow. Outer shaft 180 is formed separately from U-shaped bracket 12 and inner shaft 160. Inner shaft 160 has an outer surface 161, a top end 162, a bottom end 164, a top portion 166*a* and a bottom portion 166*b*. Inner shaft 160 is preferably hollow. Top end 162 has a pin 163 protruding upwardly therefrom. Pin 163 includes first and second stem portions 164*a,* 164*b* and first and second semicircular head portions 165*a,* 165*b* separated from each other by a space 165*c* approximately 1/16" wide. The length of stem portions 164*a,* 164*b* is preferably about ¼", the width of the stem portions 164*a,* 164*b* is preferably about ⅛" and the width of head portions 165*a,* 165*b* is preferably about ¼".

First and second semicircular platforms 170, 172 are attached to upper surface 30*a* of base portion 30 of U-shaped bracket 12 as follows. Each platform 170, 172 is preferably a semicircular-shaped piece having an upper surface 171, 173, at first end 174, 175 spaced apart from upper surface 30*a* of base portion 30 of U-shaped bracket 12 by a distance of about ¼" and a second end 176, 177 attached to upper surface 30*a* by vertical portion 178, 179. Thus, first end 174, second 176 and vertical portion 178 of first platform 170 define a slot 170*a* therein which allows first platform 170 to be flexible, and first end 175, second end 177 and vertical portion 179 of second platform 172 define a slot 172*a* therein which allows second platform 172 to be flexible.

Other shaft or spindle 180 is a hollow cylinder having an outer surface 181, a top end 182, a bottom end 184, top and bottom portions 186*a*, 186*b* and a bottom lip 167 having an upper surface 167*a* and a lower surface 167*b*. Bottom lip 167 is cylindrical and extends vertically outwardly from bottom end 184 of outer shaft 180. The width $W^1$ of bottom lip 67 is preferably about 3". An opening 181*a* is formed in top end 182 of outer shaft 180, and an inner circumferential rib 181*b* is provided around the inner surface 181' of outer shaft 180 and extends vertically outwardly therefrom.

Projections 183 having top and bottom ends 183*a*, 183*b* are provided on outer surface 181 of outer shaft 180 and project vertically outwardly therefrom as follows. Top end 183*a* of each projection 183 is unattached and spaced apart from outer surface 181 and bottom end 184 of outer spindle 180 by a distance of 3/16". Bottom end 183*b* of each projection 183 preferably rests on upper surface 167*a* of lip 167. First and second slots 189, 189' are provided on either side of each projection 183 and are parallel thereto.

Preferably, projections 183 are tapered rib-shaped projections have a width of about 3/16" at top end 183*a*, and width of about ¼" at bottom end 183*b* and a length of about 4". Top end 183*a* of each projection 183 is preferably located about ½" apart from top end 182 of outer shaft 180. Each slot 189, 189' is about 4' and 1/16" wide. Preferably, about 3 projections are provided around outer surface 181 and are spaced apart from equidistant from each other at about 120 degrees around the circumference of outer shaft 180.

Projections 183 allow outer shaft 180 to accommodate paper rolls with varying diameters. Inner shaft 160 and outer shaft 180 are assembled as follows. Opening 181*a* and inner ridge 181*b* formed at top end 182 of outer shaft 180 are configured to engage semicircular head portions 165*a*, 165*b* of pin 163 of inner shaft 160 in a snap fit. Bottom surface 167*b* of lip 167 of outer shaft 180 rests on upper surfaces 171, 173 of first and second flexible platforms 170, 172. All other dimensions of device 100 are identical to the other embodiments discussed above. First and second flexible platforms 170, 172 provide rotational friction between inner shaft 160 and outer shaft 180 for even dispensing of paper.

Projections 183 center paper roll 400 over outer shaft 180 and hold paper roll 400 in place. Specifically, when a paper roll is inserted over outer shell 180, projections 183 press against the inner surface of the paper roll and bottom ends 183*b* of projections 183 press against upper surface 167*a* of lip 167, thereby centering the paper roll over outer shaft 180 and holding it in place to prevent the roll from rotating around outer shaft 180. The paper roll and outer shaft 180 are thus connected and rotate together around the vertical axis of inner shaft 160.

The snap fit between pin 163 of inner shaft 160 and opening 181*a* and inner ridge 181*b* of outer shaft 180 and the engagement between bottom lip 167 and first and second flexible platforms 170, 172 provides a friction fit between inner and outer shafts 160, 180 as follows. The snap fit creates friction between inner ridge 181*b* of outer shaft 180 and semicircular head portions 165*a*, 165*b* of pin 163 of inner shaft 160. Bottom surface 167*b* of bottom lip 167 presses against upper surface 171, 173 of first and second flexible platforms 170, 172 pressing them downward and creating a friction fit between outer shaft 180 and inner shaft 160. This friction prevents outer shaft 180 from rotating too freely around inner shaft 160. The friction fit between inner and outer shafts 160, 180 allow for even dispensing of paper from the roll during use.

Fifth Embodiment of the Invention

Figure 5:
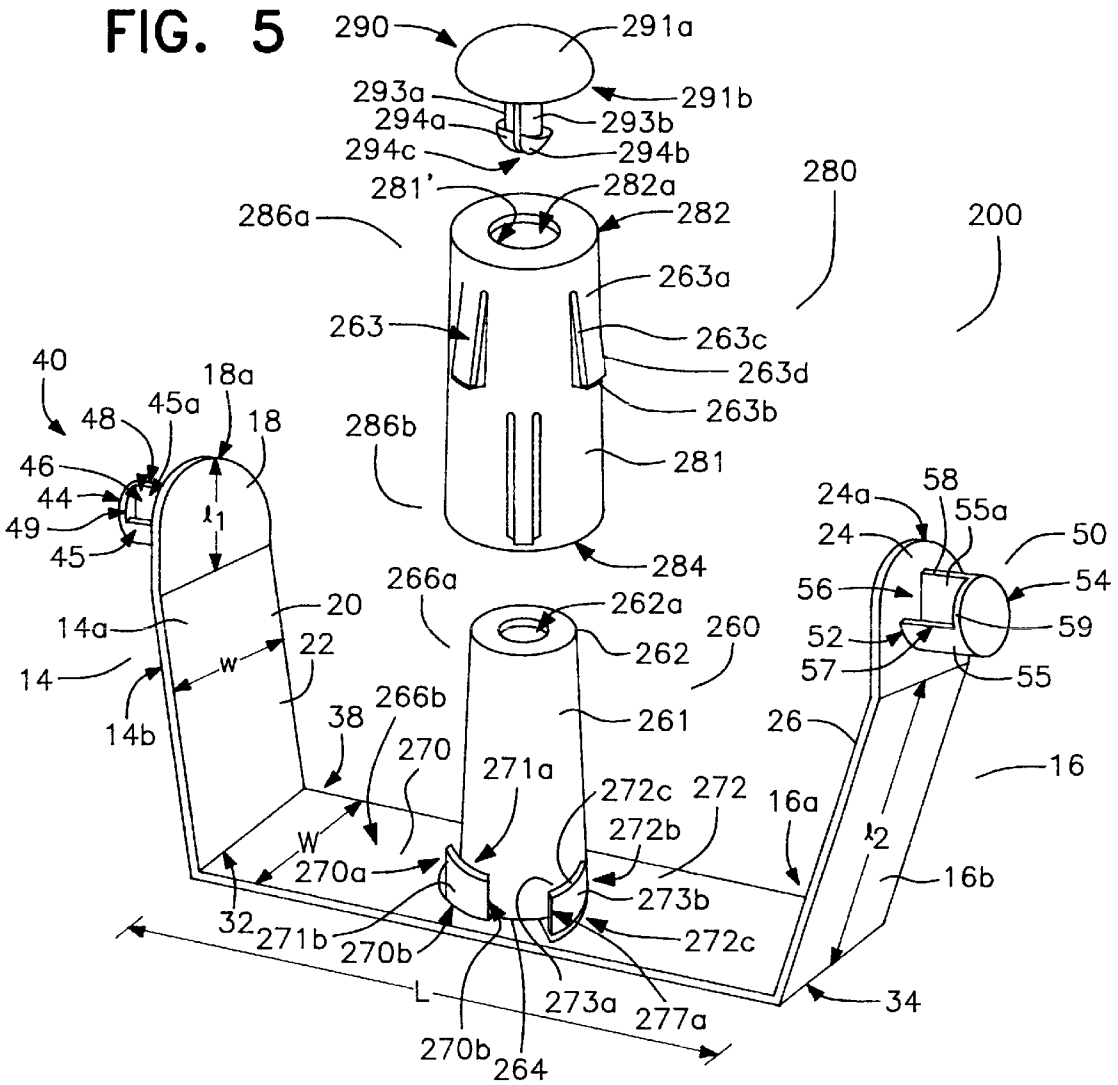
FIG. 5 is an exploded view of the fifth embodiment of the invention.

Referring to FIG. 5, like structures are indicated by the same reference numerals used in FIGS. 1–1D, 2, 2A, 3, 4 and 4A unless otherwise indicated. As illustrated in FIG. 5, the fifth embodiment of the invention is a three piece design. Inner shaft 260 of dispenser 200 has an outer surface 261, an upper end 262 with a hole 262*a* formed therein, a bottom end 264 and top and bottom portions 266*a*, 266*b*.

First and second flexible tabs 270, 272 include first ends 270*a*, 272*a*, second ends 270*b*, 272*b*, top edges 270*c*, 272*c*, bottom edges 270*d*, 272*d*, inner surfaces 271*a*, 273*a* and outer surfaces 271*b*, 273*b*. Second ends 270*b*, 272*b* are attached to outer wall 261 of inner shaft 260 so that bottom edges 270*d*, 272*d* are adjacent top surface 30*a* of base portion 30 of bracket 12 and top edges 270*c*, 272*c* face upward. First ends 270*a*, 272*a* are spaced apart from outer surface 261 of inner shaft 260 at a distance of about 1/16".

Outer shaft 280 has an outer surface 281, top end 282 with a hole 282*a* formed therein, bottom end 284, top and bottom portions 286*a*, 286*b*. Flexible projections 263 protrude outwardly from outer surface 281 to center and hold a toilet paper roll over outer shaft 280. Flexible projections 263 allow outer shaft 280 to accommodate rolls with varying diameters. Preferably, projections 263 are rectangular and have a first end 263*a* attached to outer surface 281 of outer shaft 280, a second end 263*b* spaced apart from outer surface 281 by a distance of about ⅛" and first and second sides 263*c*, 263*d* each having a length of about 1". Preferably, about 6 projections are provided on outer surface 281. They may be spaced apart from each other at the top and bottom portions 286*a*, 286*b* as shown or located in any other arrangement on surface 281.

Cap 290 has a semicircular upper surface 291*a* and a lower surface 291*b* with a pin 292 protruding vertically downwardly and outwardly therefrom. Pin 292 includes first and second stem portions 293*a*, 293*b* and first and second head portions 294*a*, 294*b* spaced apart from each other a distance of about 1/16" to define a slot 294*c* therebetween. Pin 292 is configured to engage hole 282*a* of outer shaft 280 and hole 262*a* of inner shaft 260 in a snap fit to secure dispenser 200 when assembled. The snap fit between pin 292 and holes 262*a*, 282*a* of inner and outer shafts 260, 280 holds the assembly of inner and outer shafts 260, 280 together.

When a toilet paper roll is inserted over outer shaft 280, the inner surface of the roll presses against flexible projections 263, which centers the roll over outer shaft 280 and holds it in place. Flexible projections 263 connect the paper roll and outer shaft 280 so that they rotate together toward the vertical axis of inner shaft 260 during use. There is a friction fit between pin 292 and holes 262*a*, 282*a* of inner and outer shafts 2609, 280, described above, and between inner surface 181 of outer shaft 280 and first and second flexible tabs 270, 272 as follows. Outer shaft 280 is inserted over first and second flexible tabs 270, 272 so that inner surface 281' of outer shaft 280 presses against outer surfaces 271*b*, 273*b* of first and second flexible tabs 270, 272, pushing inner surfaces 271*a*, 272*a* of first and second flexible tabs 270, 272 toward outer surface 261 of inner shaft 260. This creates a friction fit between inner and outer shafts 260, 280 which prevents outer shaft 280 from rotating too freely around inner shaft 260. The friction fit between inner and outer shafts 260, 280 allow for even dispensing of paper during use.

Sixth Embodiment of the Invention

Figure 6:
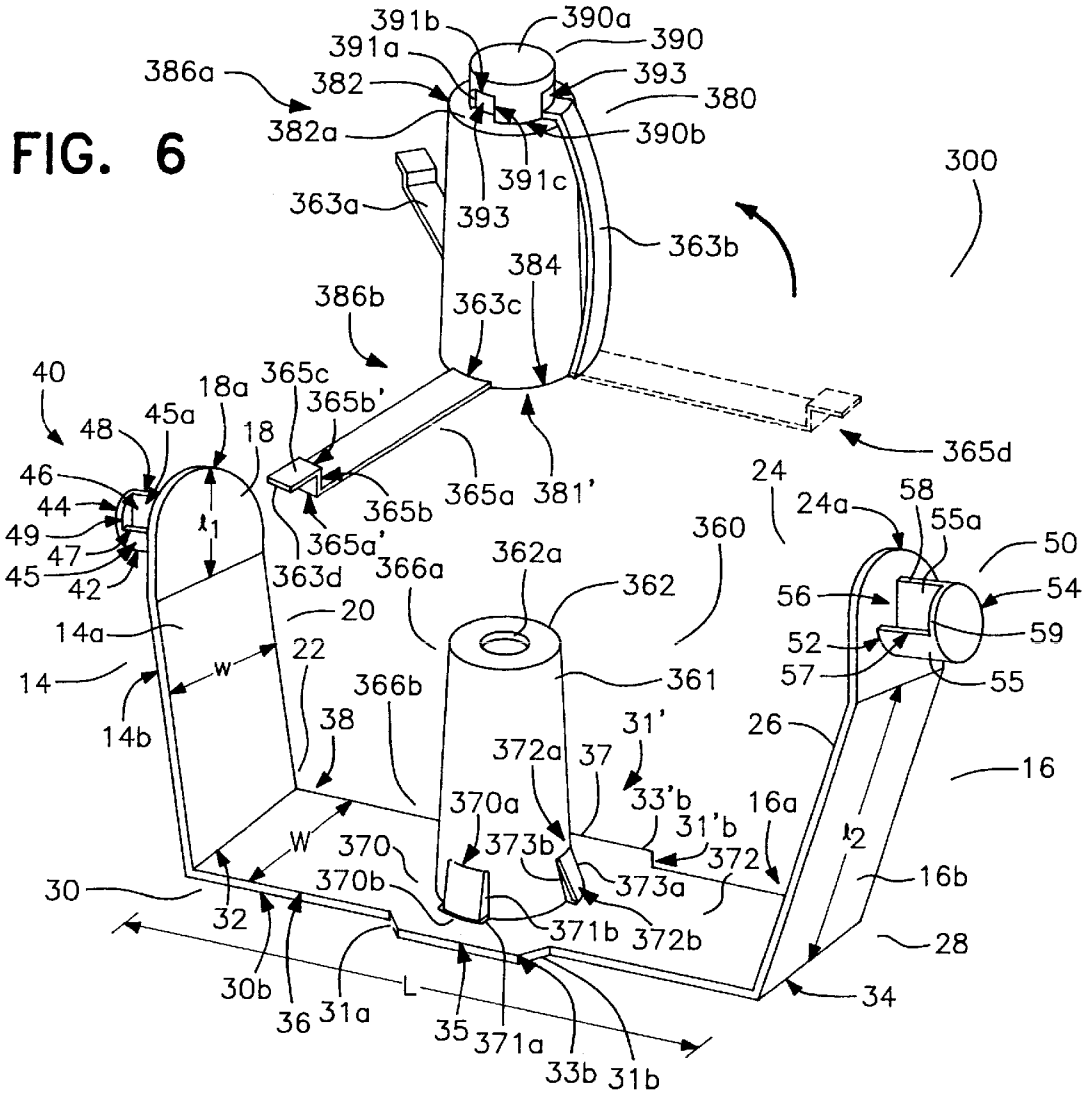
FIG. 6 is an exploded view of the sixth embodiment of the invention.

Referring to FIG. 6, like structures are indicated by the same reference numerals used in FIGS. 1–D, 2, 2A, 3, 4, 4A, and 5 unless otherwise indicated. As illustrated in FIG. 6, the sixth embodiment is a two piece design. Dispenser 300 includes an inner shaft 360 and an outer shaft 380 configured as follows. Inner shaft 360 has an outer surface 361, atop end 362 with a hole 362*a* formed therein, a bottom end 364 and upper and lower portions 366*a* and 366*b*. Preferably, three or four flexible tabs spaced equidistant from one another are provided at the bottom end 366*b* of inner shaft 360. First and second flexible tabs 370, 372 and third and fourth flexible tabs (not shown) are provided at bottom end 366*b* of inner shaft 360 and are spaced apart equidistant from each other. First and second flexible tabs 370, 372 and third and fourth flexible tabs (not shown) can be rectangular or square and have top ends 370*a,* 372*a* attached to outer surface 361 of inner shaft 360 and free bottom ends 370*b,* 372*b* that spaced apart from outer surface 361 by a distance of about 120 degrees and rest on top surface 30*a* of base portion 30 of U-shaped bracket 12. First and second flexible tabs have outer surfaces 371*a,* 373*a* which face outwardly and inner surfaces 371*b,* 373*b* which face inwards toward outer surface 361 of inner shaft 360. Preferably, first and second tabs 370, 372 are about 4" long and ¼" wide.

Base portion 30 of U-shaped bracket 30*a* includes first and second protruding portions 31, 31' formed in first and second sides 36, 38 and centered along the length L of base portion 30. First and second protruding portions 31, 31' are defined by first and second side edge portions 31*a,* 31*b,* 31'*a* (not shown), 31'*b* which extends outwardly from first and second sides 36, 38 of base portion 30 at an angle of about 45 degrees and connect at first and second corners 33*a,* 33*b,* 33'*a* (not shown), 33'*b* of first and second middle edge portions 35, 37 at an angle of about 135 degrees. First and second side edge portions 31*a,* 31*b,* 31'*a* (not shown), 31'*b* are preferably about ⅛" long. First and second middle edge portions 35, 37 are parallel to each other and are preferably about 2" long. First and second protruding portions 31, 31' provide strength to base 30 and first and second flexible tabs 370, 372.

Outer shaft 380 has an outer surface 381, a top end 382 with an upper surface 382*a,* a bottom end 384 and upper and lower portions 386*a,* 386*b*. A cylindrical cap 390 having an upper surface 390*a* and a bottom edge 390*b* is attached to and extends vertically upwardly from upper surface 382*a* of top end 382 of outer shaft 380 at bottom edge 390*b*. Cap 390 preferably has a diameter of about 1 ½" and a height of about 4 ½". Preferably, cap 390 and outer shaft 380 are formed as a single piece. Notches 393 are formed in cap 390 and defined by first, second and third sides 391*a,* 391*b,* 391*c*. The length of each notch 393 is preferably about ¼" and the width of each notch 393 is preferably about 1/16".

Protrusions 363 are preferably rectangular shaped arms having upper and lower surfaces 363*a,* 363*b* and first and second ends 363*c,* 363*d*. First end 363*c* is attached to bottom end 384 of outer cylinder 380. Protrusions 363 are preferably spaced equidistant from each other around the circumference of bottom end 384 of outer cylinder 380. Bottom horizontal portion 365*a* extends vertically outwardly from bottom 384 of outer shaft 380 at first end 363*c* at a 90 degree angle. Bottom horizontal portion 365*a* preferably has a length of about 4 2/1" and a width of about ¼". Vertical side portion 365*b* extends vertically upwardly from outer end 365'*a* of bottom horizontal portion 365*a* at a 90 degree angle to its top end 365*b*'. Vertical side portion 365*b* extends vertically outwardly from top end 365'*b* of vertical side portion 365*b* to end 363*d* to define a notch 365*d* between vertical side portion 365*b* and top horizontal portion 365*c*. Top horizontal portion preferably has a length of about ¼" and a width of about ¼". Notch 365*d* is configured to engage notches 393 in cap 390.

When assembled, vertical side portion 365*b* and top horizontal portion 365*c* of protrusion 363 engage notch 393 of cap 390 so that upper surface 363*a* of protrusion 363 faces outer surface 381 of outer shaft 380 and bottom surface 363*b* of protrusion 363 faces outwardly.

When a paper roll is inserted over outer shaft 380, protrusions 363 center the paper roll over outer shaft 380 and hold it in place. Thus, the paper roll and outer shaft 380 are connected and rotate together around the vertical axis of inner shaft 360 during use. There is a friction fit between inner and outer shafts 360, 380 as follows. Outer shaft 380 is inserted over inner shaft 360 so that inner surface 381' of outer shaft 380 covers first and second flexible tabs 370, 372 and third and fourth flexible tabs (not shown) and presses against outer surfaces 371*a,* 373*a* f first and second flexible tabs 370, 372 (and outer surfaces of the third and fourth flexible tabs, not shown), pushing inner surfaces 371*b,* 373*b* of first and second flexible tabs 370, 372 toward the outer surface 361 of inner shaft 360. This creates a friction fit between inner and outer shafts 360, 380 which prevents outer shaft 380 from rotating too freely around inner shaft 360. The friction fit between inner and outer shafts 260, 280 allows for even dispensing of the paper during use.

Figure 7B:
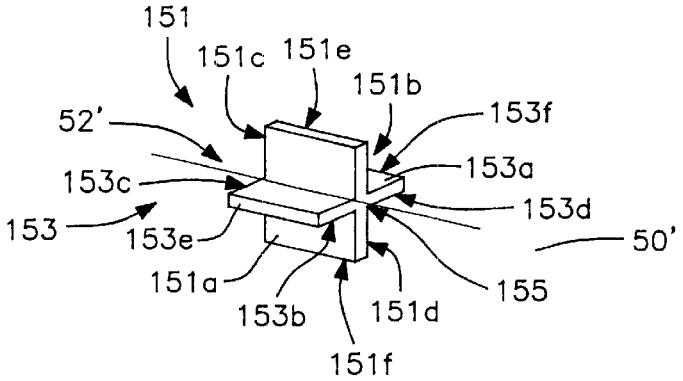

It is to be understood that first and second mounting points 40, 50 of the first through sixth embodiments may be of any shape and dimension sufficient to engage first and second indents 5*a* of mounting brackets 5 of a conventional toilet paper roll dispenser. For example, a first alternate embodiment of outer mounting point 50' is illustrated in FIG. 7B. Here, outer mounting point 50' (and the inner mounting, not shown) is a cross-shaped protrusion formed by first and second perpendicular portions 151, 153 attached at their centers at 90 degrees angles to form a cross having a center 155 and inner and outer ends 52', 54'. First perpendicular portion 151 is rectangular shaped and has first and second surfaces 151*a,* 151*b,* inner end 151*c,* outer end 151*d,* upper edge 151*e* and lower edge 151*f*. Similarly, second perpendicular portion 153 is rectangular in shape and has first and second surfaces 153*a,* 153*b,* inner end 153*c,* outer end 153*d,* front edge 153*e* and rear edge 153*f*. The length of both first and second perpendicular portions 151, 153 is preferably about ⅜", their width is preferably about 3/16" and their depth is preferably about 1/16".

Figure 7C:
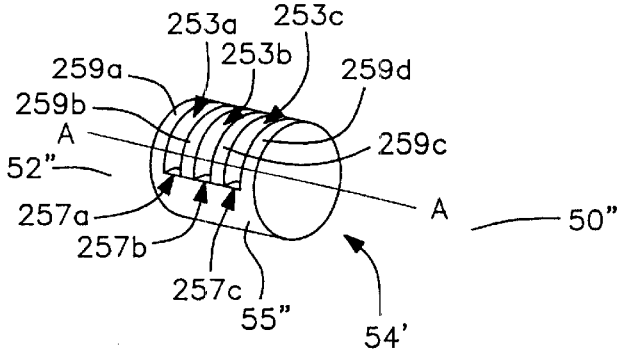

A second alternate embodiment of outer mounting point 50" is illustrated in FIG. 7C. Here, outer mounting point 50" (and the inner mounting point, not shown) is cylindrical, having an inner end 52", an outer end 54", an outer surface 55" with first, second and third notches 253*a,* 253*b,* 253*c* formed therein. Preferably, first, second and third notches 253*a,* 253*b,* 253*c* are oriented perpendicular to horizontal axis A—A of mounting point 50". First notch 253*a* is defined by inner rib portion 259*a,* first middle rib portion 259*b* and first side portions 257*a*. Second notch 253*b* is defined by first middle rib portion 259*b,* second middle rib portion 259*c,* and second side portions 257*b*. Third notch 253*c* is defined by second middle ridge portion 259*c,* outer rib portion 259*d* and third side portions 257*c*. The width of the first middle rib portions 259*b,* 259*c* is preferably about 1 1/16".

Figure 7D:
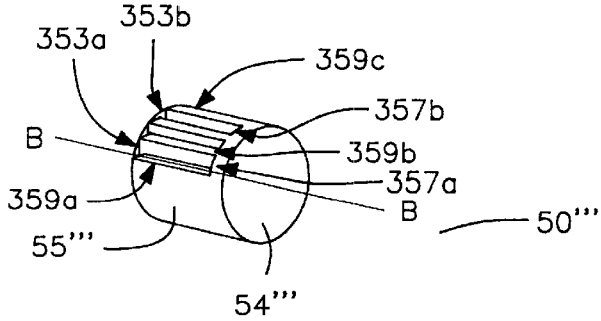

A further alternative embodiment for mounting points 40, 50 is illustrated in FIG. 7D. As shown in FIG. 7D, outer mounting point 50'" (and the inner mounting point, not shown) is cylindrical and has an inner end 52'", and outer end 54'" and outer surface 55'" having two or more notches 353*a,* 353*b* formed therein. Preferably, first and second notches 353*a,* 353*b* are oriented parallel to the horizontal axis B—B of outer mounting point 50'". First notch 353*a* is defined by first side portion 359*a,* middle rib portion 359*b* and first outer side portion 357*a.* Second notch 353*b* is defined by middle rib portion 359*b,* second side portion 359*b* and second outer side portion 357*b.* Preferably, the width of middle rib portion 359*b* is about 1/16".

Seventh Embodiment of the Invention

Figure 8:
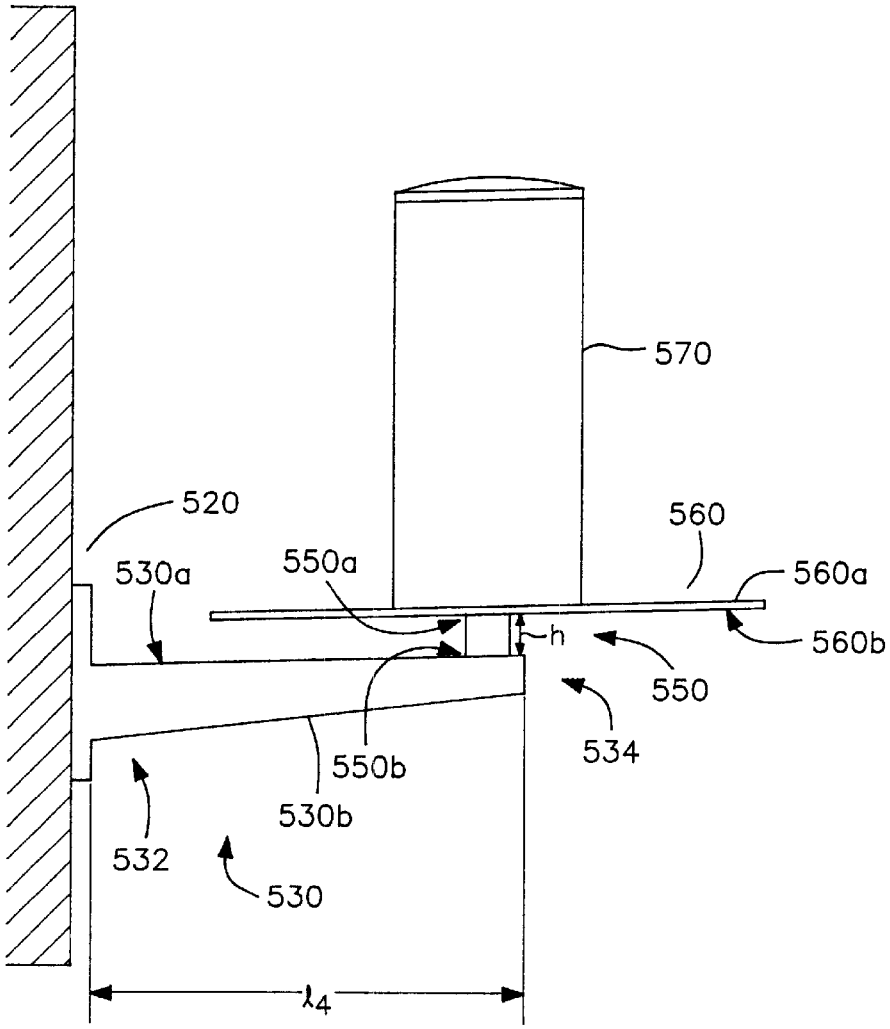
FIG. 8 is a side view of the seventh embodiment of the invention.
Figure 8A:
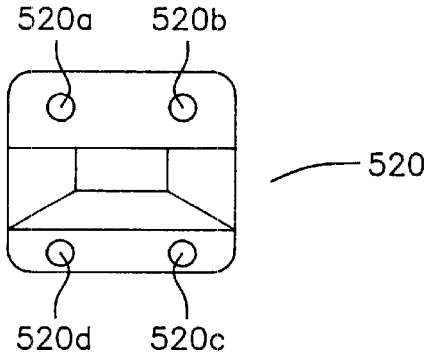
FIG. 8A is a front view of the mounting bracket of the seventh embodiment of the invention.

The seventh embodiment of the invention is illustrated in FIGS. 8 and 8A. This embodiment is not used in connection with the mounting brackets of a conventional toilet paper roll dispenser. Rather, dispenser 510 is provided with a mounting bracket 520 configured to be attached to any vertically-oriented surface, such as a wall or the side of a vanity or counter. Mounting bracket 520 is preferably a rectangular-shaped bracket having a length of about 3 3/4" and a width of about 2". First, second, third and fourth holes 520*a,* 520*b,* 520*c,* 520*d* are formed in each comer of mounting bracket 520 and are configured to receive conventional mounting screws of mollies or any other suitable fastener (not shown) for attaching mounting bracket 520 to a vertical surface.

Dispenser 510 further includes a base or platform 530 having upper and lower surfaces 530*a,* 530*b* and first and second ends 532, 534. First end 532 is attached to a vertical surface, such as a wall by mounting bracket 520 so that the second end 534 of platform 530 extends vertically outwardly from mounting bracket 520. Platform 530 may be rectangular, triangular, or any other suitable shape. Preferably, platform 530 has a length $1_4$ of about 3.5".

A pedestal 550 having top and bottom ends 550*a,* 550*b* is attached at its bottom end 550*b* to upper surface 530*a* of platform 530 at its second end 534. Top end 550*a* of pedestal 550 extends vertically upwardly from upper surface 530*a* of platform 530 and is connected to the lower surface 560*b* of a platter 560. Pedestal 550 may be cylindrical, rectangular, square, or any other shape suitable to support platter 560. The height h of pedestal 550 is preferably about 1/8".

Platter 560 may be cylindrical, rectangular, square, or any other shape suitable to support cylindrical shaft 570 and a paper roll inserted over cylindrical shaft 570. Preferably, platter 560 is planar.

Cylindrical shaft 570 protrudes vertically upwardly from upper surface 560*a* of platter 560 at an angle of about 90 degrees and is configured to receive a roll of toilet paper (not shown). When a paper roll is inserted over cylindrical shaft 570, its bottom edge rests on upper surface 560*a* of the platter 560.

Alternatively, cylindrical shaft 570 can be configured as each of the shafts 60, 60', 60" or inner and outer shafts 160 and 180, 260 and 280, or 360 and 380 as described above in relationship to the $1^{st}$, 2d, 3d, $4^{th}$, $5^{th}$ and $6^{th}$ embodiments of the invention. The inventive device of the first through the seventh embodiments is preferably formed of injection molded plastic and can be made of any color plastic or can be metal-plated to provide any desired finish for decorating purposes.

Modifications and variations of the above described embodiment of the present invention are possible, as appreciated by those skilled in the art in light of the above teachings. For example, the projections formed on inner and outer shaft of each embodiment can be of any size, shape or number sufficient to center and hold a paper roll on the outer shaft and provide enough friction between the inner and outer shaft to allow for even paper distribution during use. The bracket 520, pedestal 550, and platter 560 can be any shape or dimension suitable to position a paper roll over shaft 570. Shaft 570 can be a single piece design as described in the first through third and seventh embodiments, or a two-piece design as described in the fourth through sixth embodiments. It is therefore to be understood that, within the scope of the appended claims and their equivalents, the invention may be practiced otherwise than as specifically described.

What is claimed is:

1. A paper roll dispenser comprising:

a U-shaped bracket including a horizontally-oriented base portion having first and second sides and an upper surface and first and second arms extending vertically upwardly therefrom, each of said first and second arms having an inner surface, and outer surface, a top end and a bottom end, wherein said bottom ends of said first and second arms are connected to said first and second sides of said base portion, respectively;

first and second mounting points extending horizontally outwardly from said outer surfaces of said first and second arms at said top ends of said first and second arms, wherein said first and second mounting points are configured to engage recesses in toilet paper dispenser mounting brackets, and wherein each of said first and second mounting points has a first end connected to the outer surface of said first and second arms at said top ends of said arms, a sidewall and an outer end spaced apart from said inner end by said sidewall; and a cylindrical spindle connected to said upper surface of said base and extending vertically upwardly therefrom, wherein said spindle is configured to receive the hollow tube of a paper roll.

2. The dispenser of claim 1, wherein said spindle has an outer surface and further comprises:

at least one projection extending vertically outwardly from said outer surface of said spindle.

3. The dispenser of claim 2, wherein said at least one projection comprises:

a first planar portion having first and second sides, said first side connected to said outer surface of said spindle and extending vertically outwardly therefrom; and a second planar portion having first and second sides, said first side of said second planar portion being connected to said second side of said first planar portion and said second side of said second planar portion extending vertically outwardly therefrom so that said second planar portion is substantially parallel to said outer surface of said cylinder.

4. The dispenser of claim 1, wherein said mounting points are cylindrically-shaped and wherein said sidewall of each mounting point has first, second and third sides which define a notch formed in said sidewall.

5. The dispenser of claim 1, wherein said mounting points comprise first and second rectangular planar sections oriented perpendicularly to each other and connected along their center length so that said mounting points have an X-shaped cross-section.

6. The dispenser of claim 1, wherein said mounting points are cylindrically-shaped and wherein each mounting point has a sidewall having two or more slots formed therein.

7. The dispenser of claim 1, further comprising a hollow cylindrical outer shaft having an inner surface and an outer surface, wherein said outer shaft is configured to receive said spindle and said outer surface of said outer shaft is configured to receive the hollow tube of a paper roll.

8. The dispenser of claim 7, further comprising projections extending vertically outwardly from said outer surface of said outer shaft.

9. The dispenser of claim 7, wherein said base further comprises a platform extending vertically upwardly from said upper surface of said base, said platform having an upper surface;

said outer shaft has a top end and a bottom end and further comprises a circumferential lip extending vertically outwardly from said bottom end, said lip having a bottom surface;

and wherein said lower surface of said lip rests on said upper surface of said platform to provide a friction fit between said outer shaft and said platform during use.

10. The dispenser of claim 7, wherein said spindle further comprises engaging means for engaging said spindle with said inner surface of said outer shaft in a friction fit, said engaging means being attached to said outer surface of said spindle and extending outwardly therefrom.

11. The dispenser of claim 7, further comprising a cap configured to engage said top end of said outer shaft and said top end of said spindle to secure said outer shaft in place over said spindle while allowing said outer shaft to rotate around the axis of said spindle.

12. The dispenser of claim 7, wherein said spindle has a top end, said outer shaft has a top end, and further comprising:

engaging means provided at said top end of said spindle for engaging receiving means provided at said top end of said outer shaft;

said receiving means provided at said top end of said outer shaft being configured to receive said engaging means of said spindle so that said engaging means and said receiving means connect said spindle and said outer shaft in a snip fit when assembled.

* * * * *